US008597319B2

(12) United States Patent
Mukhina et al.

(10) Patent No.: US 8,597,319 B2
(45) Date of Patent: Dec. 3, 2013

(54) METHOD FOR PROLONGING THE ACTION ON ACUPUNCTURE POINTS FOR REDUCING BODY WEIGHT

(75) Inventors: Mariyat Muradaliyevna Mukhina, Tver (RU); Nikolay Veniaminovich Chadayev, Tver (RU)

(73) Assignee: Frey Medical Technologies AG, Lausanne (CH)

( * ) Notice: Subject to any disclaimer, the term of this patent is extended or adjusted under 35 U.S.C. 154(b) by 876 days.

(21) Appl. No.: 11/996,201

(22) PCT Filed: Jul. 19, 2006

(86) PCT No.: PCT/RU2006/000385
§ 371 (c)(1),
(2), (4) Date: May 8, 2008

(87) PCT Pub. No.: WO2007/011266
PCT Pub. Date: Jan. 25, 2007

(65) Prior Publication Data

US 2008/0215080 A1 Sep. 4, 2008

(30) Foreign Application Priority Data

| | | |
|---|---|---|
| Jul. 20, 2005 | (RU) | 2005123065 |
| Nov. 10, 2005 | (RU) | 2005134870 |
| Jun. 16, 2006 | (RU) | 2006121353 |
| Jun. 23, 2006 | (RU) | 2006122385 |
| Jul. 18, 2006 | (RU) | 2006125777 |

(51) Int. Cl.
*A61H 39/08* (2006.01)

(52) U.S. Cl.
USPC ..... 606/189; 128/907

(58) Field of Classification Search
USPC ..... 606/189; 600/548; 128/907
See application file for complete search history.

(56) References Cited

U.S. PATENT DOCUMENTS

| | | | | |
|---|---|---|---|---|
| 4,086,786 | A | 5/1978 | Ritter | |
| 4,195,492 | A * | 4/1980 | Johnson | 63/12 |

(Continued)

FOREIGN PATENT DOCUMENTS

| | | | |
|---|---|---|---|
| CN | 87103554 | A | 2/1988 |
| CN | 2223096 | Y | 3/1996 |

(Continued)

OTHER PUBLICATIONS

Jun et al "Point-Penetration Acupuncture: Hisotrical Development and Clinical Application" Acupuncture in Medicine vol. 17(1). p. 36-41 Jun. 1999.*

(Continued)

*Primary Examiner* — Ryan Severson
*Assistant Examiner* — Rachel S Papeika
(74) *Attorney, Agent, or Firm* — Finnegan, Henderson, Farabow, Garrett & Dunner, LLP

(57) ABSTRACT

A method for acupuncture reflexotherapy is disclosed. The method may include introducing a needle rod having a head formed at a first end into one or more auricular acupuncture points of a patient. The needle may be secured to the patient with a detachable retainer at a second end of the needle rod. Additionally, the retainer may be non-detachable from the needle rod and may be formed by a bended free end of the needle rod. The method may further include varying one or more parameters of the needle rod, head, or retainer to alter a stimulating effect on the auricular acupuncture points and induce weight loss.

19 Claims, 7 Drawing Sheets

(56) References Cited

U.S. PATENT DOCUMENTS

| | | | | | |
|---|---|---|---|---|---|
| 4,262,672 | A | * | 4/1981 | Kief | 606/189 |
| 4,781,190 | A | | 11/1988 | Lee | |
| 4,803,852 | A | | 2/1989 | Waldron | |
| 5,465,593 | A | * | 11/1995 | Takasu | 63/12 |
| 5,505,061 | A | | 4/1996 | Fleury, Jr. et al. | |
| 5,735,143 | A | * | 4/1998 | Tanaka | 63/14.3 |
| 7,155,287 | B2 | * | 12/2006 | Gavronsky | 607/46 |
| 2002/0169357 | A1 | * | 11/2002 | Chen | 600/15 |

FOREIGN PATENT DOCUMENTS

| | | | | |
|---|---|---|---|---|
| CN | 1200256 | A | | 12/1998 |
| EP | 0 241 625 | A2 | | 4/1986 |
| EP | 0271775 | | | 6/1988 |
| EP | 0 715 819 | A1 | | 6/1996 |
| EP | 1586293 | A1 | * | 10/2005 |
| JP | 363311956 | | * | 12/1988 |
| JP | 7-477 | | | 1/1995 |
| JP | 7-000477 | | | 6/1995 |
| JP | 8-10311 | | | 1/1996 |
| JP | 408010311 | | * | 1/1996 |
| JP | 8-098708 | | | 4/1996 |
| JP | 11-46823 | | | 2/1999 |
| JP | 3092500 | | | 12/2002 |
| RU | 1264942 | | | 10/1986 |
| RU | 1335286 | | | 9/1987 |
| RU | 1680177 | | | 9/1991 |
| RU | 1804764 | | | 3/1993 |
| RU | 2018300 | | | 8/1994 |
| RU | 92000824 | | | 7/1996 |
| RU | 93052109 | | | 9/1996 |
| RU | 2145834 | | | 2/2000 |
| RU | 2176496 | | | 12/2001 |
| RU | 26402 | | | 12/2002 |
| RU | 1296164 | | | 12/2002 |
| RU | 2195917 | | | 1/2003 |
| RU | 2212060 | | | 9/2003 |
| RU | 2233149 | | * | 7/2004 |
| RU | 2003107817 | | | 12/2004 |
| SU | 952252 | A1 | | 8/1982 |
| SU | 1680177 | | * | 9/1991 |
| WO | WO 87/06143 | | | 10/1987 |
| WO | WO 94/05178 | | | 3/1994 |

OTHER PUBLICATIONS

"Steel Sideburns!" www.bme.com.*

Jin Tai "Observations on Therapeutic Effects of Electroacupuncture in Simple Obesity" Journal of Acupuncture and Tuina Science vol. 2 No. 2 p. 20-22 (2004).*

Shiraishi et al "Effects of Bilateral Auricular Acupuncture Stimulation on Body Weight in Healthy Volunteers and Mildly Obese Patients" Society for Experimental Biology and Medicine. p. 1201-1207 (2003).* www.chooseacupuncture.com/whatwhy.htm.*

The Point Issue 25, The Official Newsletter of the Association of Professional Piercers. Jun. 2003.*

Ukrasheniya dlya nirsinga, 2004; web-site http://www.mixtura.ru; Dec. 7, 2005; pp. 1-3.

Spravochnik, Statya "Shtanga"; web-site http://piercing.ru; May 3, 2005; p. 1.

International Search Report; PCT/RU2006/000385; Nov. 2006.

O.M. Kokhanovich "Tezisy respublikanskoy nauchnoy conferentsii Nemedikamentoznye metody kupirovanija khronicheskikh bolevykh sindromov" (Abstracts of the Republican Scientific Conference "Non-medicinal methods for curing chronic pain syndromes"), published in 1989, p. 73.

p. 228 of "G. Luvsan "Ocherki metodov vostochnoy reflexoterapii" (Scratches of Oriental Reflexotherapy Methods", Novosibirsk, "Nauka" publishers, Siberian Department, 1991.

G. Barashkov, Reflexoteraija boli (Reflexotherapy of pain, TM-Oko; NCMI "Universimed", Moscow, 1995, pp. 185-186 (with translation).

Office Action from Korean Patent Office in corresponding Korean Patent Application No. 10-2008-7004107, dated Apr. 28, 2011, 5 pages.

Examination Report from New Zealand Intellectual Property Office in Application No. 592737, dated May 12, 2011, 3 pages.

Examination Report from New Zealand Intellectual Property Office in Application No. 566066, dated May 12, 2011, 2 pages.

Communication from Japanese Patent office in Japanese Application No. 2008-522729, dated Sep. 6, 2011 and translation thereof. 4 pages including 3 pages of communication and one page of translation.

Examination Report from New Zealand Intellectual Property Office in Application No. 592736, dated May 12, 2011, 2 pages.

Official communication issued by New Zealand Patent Office, dated Sep. 5, 2012 for counterpart New Zealand Patent Application No. 592737 (2 pages).

Official communication issued by New Zealand Patent Office, dated Sep. 5, 2012 for counterpart New Zealand Patent Application No. 592736 (2 pages).

Official communication issued by Serbia Patent Office, dated Aug. 20, 2012 for counterpart Serbia Patent Application No. P-74/2008 (3 pages).

Office Action in corresponding Canadian patent application No. 2,616,134 dated Oct. 19, 2012 (4 pages).

Patent Examination Report No. 2 in corresponding Australian patent application No. 2006270526 dated Dec. 6, 2012 (4 pages).

Patent Examination Report No. 3 in corresponding Australian patent application No. 2006270526 dated Dec. 21, 2012 (4 pages).

Office Action in corresponding Cuban patent application No. 2008-0016 dated Nov. 23, 2012.

* cited by examiner

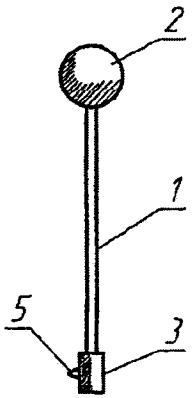
Fig. 1
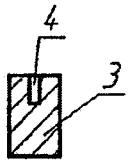
Fig. 2
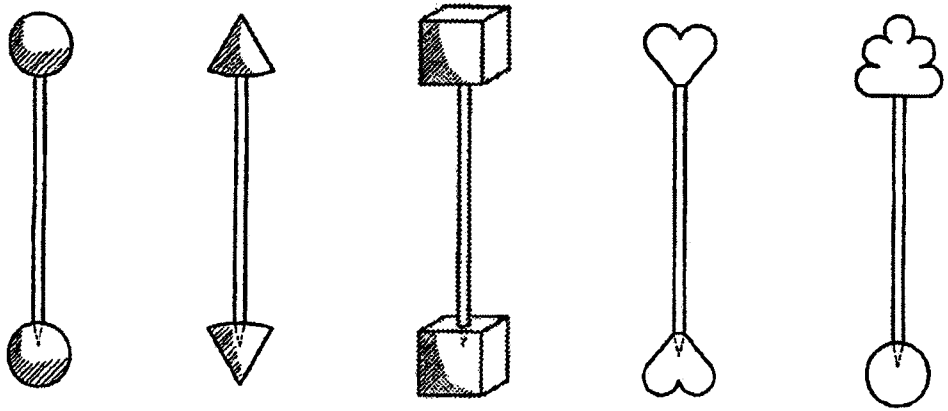
Fig. 3
Fig. 4
Fig. 5
Fig. 6
Fig. 7

METHOD FOR PROLONGING THE ACTION ON ACUPUNCTURE POINTS FOR REDUCING BODY WEIGHT

FIELD OF THE INVENTION

The group of the inventions relates to medicine, namely, to the field of acupuncture reflexotherapy that, in particular, promotes reduction of an excessive body weight (treating obesity).

The problem of health status of the people suffering from an excessive body weight becomes still more actual. Social-economic backgrounds of the last decade resulted in steady increase in the number of individuals with obesity making up to 50% of adult population.

Obesity is a biological event characterized by an increased adipose tissue mass throughout all the body with a prevalent localization thereof in the hypodermic tissue.

A human suffering from an excessive body weight cannot usually achieve a stable reduction thereof, since the motivation of an excessive consumption of high-energy foodstuffs built in his or her mind is constantly supported by a macro- and micro social environment. Genotype, adipose tissue constitution, reactivity state in relation with hormonal metabolism, structural and functional irritability of the appetite and satiation centers, emotional and psychological nutrition components of an individual belong to the internal factors effecting increase in the body weight.

Numerous investigations have established that obesity is a predictor of the development of ischemic heart disease, arterial hypertension and also a broad range of cardiovascular diseases.

Thus, the problem of correcting the body mass is actual in the light of preventing and treating the most prevalent and socially important diseases.

BACKGROUND OF THE INVENTION

The use of various constructions of needles and methods of effecting acupuncture points are known for five thousand years. Massage, heating, moxibustion, puncturing etc. belong to such methods. The proposed method is characterized by the action of a needle on reflexotherapeutic points of a patient.

The analogue of the proposed method is the method of providing a sedative effect in a patient by using corporal needles known since ancient times. The effect time of these needles fluctuates according to the known method within the range from 30-40 min to maximum 1-2 hours (G. Luvsan "Ocherki metodov vostochnoy reflexoterapii" (Scatches of Oriental Reflexotherapy Methods", Novosibirsk, "Nauka-"publishers, Siberian Department, 1991, p. 228).

The described method has the following drawbacks: in certain conditions such as pronounced pain syndromes (acute and chronic diseases, cancerous and traumatic pain syndromes), allergic diseases, treating abstinent syndromes etc. the action of corporal and auricular needles is limited by duration of one procedure; a patient is forced to attend one and the same procedures for a long time and the possibility of a more prolonged therapy is not provided. Further, as the disclosures relevant to the proposed method may be called the methods of action on acupuncture points of a patient by using the needles, as described in the book by G. Barashkov "Reflexoterapija boli" (Reflexotherapy of pain, "TM-Oko" publishers and NCMI "Universimed", Moscow, 1995, pp. 185-186, 124-125; and in the article O. M. Kokhanovich "Tezisy respublikanskoy nauchnoy conferentsii "Nemedikamentoznye metody kupirovanija khronicheskikh bolevykh sindromov" (Abstracts of the Republican Scientific Conference "Non-medicinal methods for curing chronic pain syndromes"), published in 1989, pp. 73-74.

The drawbacks of the mentioned methods consists in that in the book by G. Barashkov a technique of a large puncture is described, wherein "a needle is introduced into one local point and taken through it up to another point . . . ". That is, the needle does not come out from the point, and the needle outlet point, through which a free needle end comes out on the skin surface is not described in the recited source, which means that the needle end remains wholly in a patient body.

It is clear from the terminology used by the author of the known source that a traditional introduction of needles is described for a procedure treatment of a patient that is widely known and described practically in any reference books and monographs on reflexotherapy using needles. The said influence is limited by the action of one procedure. After completion of a procedure, needles are removed and a patient is prescribed a next procedure. When carrying out this method, a patient is dependent on a physician, since the courses of the said procedures are required to achieve a positive effect.

The same drawbacks are inherent to the method described by O. M. Kokhanovich, wherein the term "threading" is mentioned unlawfully, since a needle introduction technique is described in the said document as "horizontal-subcutaneous", i.e., the needle remains in a patient body for an hour, one and a half hour and more (about two days), which is similar to the method described by G. Barashkov.

A lot of techniques and methods for correcting an increased body weight have been proposed. However, a majority of them (hypo-calorie diet, use of biologically active additives to food, enhancement of physical activity, use of suggestion and coding, massage and others) have certain limitations and not always take the effects desirable for a patient and a physician. In cases when their effect is achieved, then it is usually very unstable and often has a reversible character. At the same time, such factors as obesity history duration, type of fat deposition, age and sex characteristics of patients suffering from an excessive body weight are usually not taken into consideration.

Recently, high cost surgical methods of reducing the body weight such as plastic surgery and cryogenic lifting have found an increasingly wide use. There are a lot of contraindications to using the said methods (in particular, liposuction) because of a somatic pathology and different complications associated with their use. Furthermore, they are not available for patients in a majority of Russian regions, since carrying out these methods implies participation of a specially trained and highly qualified personnel as well as expensive equipment.

The Applicant is of the opinion that under the existing conditions, acupuncture reflexotherapy (ART) is an optimum method for correcting an excessive body weight that allows carrying out a therapy taking into consideration individual genotype of a patient, constitution of adipose tissue, reactivity state related to hormonal metabolism, structural and functional irritability of the appetite and satiation centers, as well as the types of unconditional reflexes associated with nutrition.

One of the known documents relevant to the method according to the present invention is the source describing a method for correcting an excessive body weight that comprises conduction at intervals of 14 days of auricular reflexotherapy procedures in the acupuncture points $AP_{17,18,55,87}$ using micro needles, which are secured with an adhesive plaster for 14 days. A patient carries the needles and performs autostimulation of the points by periodic pressing the adhesive plaster every 30 minutes.

In a second procedure, the micro needles were removed from one auricle and they were introduced into the same acupuncture points of the other auricle. Further, several procedures of corporal reflexotherapy were conducted (RU 2,176,496).

The described method has the following drawbacks:

1. Leaving micro needles in the auricle for 14 days is not sufficient to achieve the effect of blocking the hunger center and developing alimentary reflex of an adequate appetite.

2. The use of corporal reflexotherapy by the particular points F13, RP10, 11, 16, E19-28, VB 25, 26, 29, 31, 33, 34, V19, 48 does not provide for a full coverage of the maximum fat deposition zones not allowing thereby to correct a body efficiently.

3. A short interval between corporal procedures (1 to 3 days) causes psychological discomfort, fear of pain as well as formation of hematomas in patients.

4. Procedure duration of a prolonged therapy of auricular points using micro needles is limited in view of a natural skin regeneration and desquamation of the upper epidermal layer that promotes rejection of an adhesive plaster, and falling out the needles therewith that requires a constant replacement of the plaster and reintroduction of the micro needles. Furthermore, the drawbacks also include non-esthetic appearance of the plaster itself as well as a possible occurrence of the skin maceration under it that creates the risk of infection.

The prior art document most relevant for the proposed solution in its part relating to "a method" subject matter is a method for reducing body weight and correcting the body (treatment of obesity), which comprises introduction of a micro needle with the end rounded in the form of a loop into one of the auricular points AP17, AP18, taking it through under the skin, putting out a second end of the needle from the other AP and fixing it using a clamp. The micro needle is left in the points for 60 to 360 days. Following introduction and securing the micro needle in the AP, manipulation on fat depots is commenced. Manipulation includes a deep digital massage of a fat depot zone for 5 to 10 minutes. Following completion of the massage, an acupuncture needle is introduced into a fat fold of the zone. The needle is repeatedly turned about axis thereof, adipose tissue is wound thereon and the needle is withdrawn with a sharp movement. In case of high degree obesity a trihedral acupuncture needle may be introduced. The rest zones of the fat depot are treated in a similar way. Subsequent fat depots are treated after a period of 10 to 60 days (RU 2233149).

The described method allows for enhancing treatment efficacy and maintaining the results obtained, however, it has a number of drawbacks including:

1. Insufficient effect on the auricular points of a patient,

2. Lacking opportunity of a step by step correcting a force and direction of a reflexogenic effect, 3. Since the treatment of obesity depending on the disease degree takes a long time interval, sometimes making up several months, when carrying out the known method a patient develops an adaptation phenomenon to the action of micro needles.

As the prior art document most relevant to "a device" subject matter, a golden needle used for the same purpose, may be mentioned; the needle is designed as a rod with a blunted end and a handle in the form of a round loop with a joint. A clamp in the form of a washer is put on a free end of the needle rod (RU 26402).

A drawback of the known device consists in that during exploitation of the device, the handle designed in the form of a loop may hook hair, clothes, terry towel etc., and thus promote withdrawal of the device from the placement zone and even loss thereof, since the needle has small dimensions, as well as it may cause skin injury with a subsequent development of a scar deformity.

Furthermore, the needle construction does not allow for enhancing efficacy of reducing body weight.

SUMMARY OF THE INVENTION

Taking into consideration all the drawbacks indicated above, a novel method and variants of needle constructions and devices allowing for more efficiently reducing an excessive body weight (treating of obesity), as well as adequate correcting of a patient's body, have been developed. The method, devices and needles provide achieving of the desirable, including step-by step, stimulation of a patient's auricular points enhanced by an additional reflexogenic effect thereupon, in order to increase intensity of neural impulses entering the hypothalamus, as well as to overcome the phenomenon of a patient's adaptation to the action of micro needles, wherein the said phenomenon is formed due to prolonged (more than 60 days) presence of a needle in the zone of treatment. That will allow for increasing the term of a needle presence in selected points and will positively affect maintaining the results of treatment; at the same time, need in transposition of the needle onto the other auricle is avoided, however, in certain cases, the proposed method includes the said transposition as well as introduction of needles into the both auricles.

According to the present invention, the claimed technical result is achieved by the following combination of features.

A method for reducing an excessive body weight consists in that into one of the auricular acupuncture points AP17, AP18, and/or the auricular points indicated for neurosensory-humoral regulation of the hypothalamo-hipophyseal system and optimization of lipolytic mechanisms, and/or the auricular points indicated for formation of an adequate alimentary motivation of a patient, a corresponding needle is introduced, at one end of which a head having a volume, plate or annular shape is secured. Drawing this needle under the skin, a free end thereof is withdrawn from the other indicated auricular point. Then, a retainer having a plate or volume shape is secured at a free end of the needle. A required rate of reducing an excessive body weight is provided by the action on the zones of the indicated auricular points with a gradual increase in the weight of the head and/or the retainer, and/or by changing the area of their contact with the indicated auricular points, and/or by a progradient correlation of intensity of the action on these points.

Progradient correlation of intensity of the action on the auricular points is carried out by digital pressing and/or by electric pulse, and/or magnetic, and/or acoustic, and/or photo, and/or micro- and short-wave stimulation.

The efficacy of the proposed method allows for leaving a needle in these points for the term of up to 720 days.

According to the proposed method, a needle is introduced into the active auricle. In the development of adaptation in a patient, the needle is withdrawn from the auricle and introduced into another auricle.

Parallel introduction of needles into the both auricles is possible.

If a patient suffers from concurrent diseases, additional needles are introduced daily or every other day for 10 days into the auricular acupuncture points indicated for these diseases.

The task set by the invention can be resolved using only the features listed above. However, in certain cases, additional treatment of a patient's fat depot similar to that disclosed in the most relevant prior art document, is indicated.

Thus, following introduction of a needle into the patient's auricular points, the treatment of his or her fat depot is commenced. To this end, the indicated depot is first divided into several zones, then every zone is sequentially treated by a deep digital massage at a predetermined time interval, for example, 10 to 60 days. Then a fat fold is fixed and an acupuncture needle is introduced therein. Then, while repeatedly turning the needle around its axis, adipose tissue is wound thereon and the acupuncture needle is withdrawn by a sharp movement together with the adipose tissue wound thereon.

A deep digital massage of fat depot zones includes massaging biologically active points located in the given zone. Massage is done by vibration and/or kneading and/or pressing.

The indicated massage is preferably carried out for 5 to 10 minutes.

An acupuncture needle is introduced into a fat fold perpendicular or at an angle to the fat depot zone surface.

A trihedral needle may be introduced into a fat fold.

In the proposed method, the technical result of a prolonged effect on the acupuncture points is achieved due to the fact that acupuncture points are first topographically determined, one of which is selected as a needle inlet point, and another as an outlet point thereof to the skin surface. Then puncturing these points by threading them using, for example, one needle that having a head is performed, and a free end of the needle is bended to form a retainer therefrom.

In the variant of a lacking needle head, both terminal portions of the needle are bended to form retainers therefrom following the needle exposure.

For example, as acupuncture points the auricular points AP17 and AP18 are selected.

A needle secured with retainers is left in the auricular points for a time needed for therapy.

A needle of the shape and configuration actual for a given body site and a set task, is manufactured of a material, which is biologically neutral for a patient that, together with the features described above, provides the needle location time in the points, which is needed for a complete curing or controlling a given symptom complex.

The instant method may be used to act on any acupuncture points on the both auricular skin and the body as well as mucous membranes of a patient. As an example of treating obesity, acupuncture of the points AP17, AP18 on the auricle is given consideration. Following topographic determination of two points on an auricle, one of them is selected as a needle inlet point and another as an outlet point. The points are punctured by threading them with one needle.

In order to reliably secure this needle on the auricular skin, permanent retainer(s) is(are) used.

A permanent retainer is formed in the following way. Following withdrawal of a free end of a needle having a head from the skin surface, the indicated end is bended to form a retainer therefrom.

Advantageously, in case of using corporal needles, a retainer may be obtained by coiling one or both bended terminal needle portions around free portions thereof.

For auricular needles, each retainer may be obtained by coiling a needle bended end to form a tangle or at least one coil turn.

A needle can be designed of a metal, for example gold, silver, alloyed steel or an alloy of metals. The needle can be also designed of a polymeric material or combined of different materials.

The needle can be designed of rubber having a metal tip.

A free needle end or a tip can be designed of a shape memory alloy of metals.

A needle for needle reflexotherapy (acupuncture reflexotherapy) in particular auriculotherapy, consists of a rod with a head (a first variant), designed as was already mentioned of a material biologically neutral for a patient.

According to a second variant, a rod of the indicated needle has no head.

The whole rod or one or both terminal portions thereof are designed of a material having plastic characteristics to provide for the possibility of forming a retainer(s) from a bended free end or terminal portions of the rod.

One or the both retainers can be designed in the form of the bended needle end(s) wound on the rod.

One or the both retainers can also be designed in the form of a tangle(s) or at least one coil turn.

The needle rod can be designed of a metal, for example gold, silver, alloyed steel or an alloy of metals.

The needle rod can be designed of a polymeric material.

The needle rod can be designed of a combination of different materials, for example the needle rod can be designed of rubber with a metal tip(s), and a free rod end(s) or a tip(s) can be designed of a shape memory alloy of metals.

A needle for reflexotherapy according to another variant of the invention has a smooth or a contoured rod having length not less than 5 mm and not less than 0.08 mm in diameter, and equipped with a head, a free end of the rod being designed with the possibility of connecting to at least 0.15 mm high detachable retainer. The rod head can be designed volume or plate or annular, and the retainer can be designed plate or volume and weighing at least 0.01 g.

Surface of the needle head and/or retainer can be designed rough, for example with at least one pin having a blunted end.

The retainer is designed in the form of a hood having a blind opening.

Volume head and/or hood can be designed hollow or monolith.

Volume rod head and/or hood can be designed in the form of a spatial geometric body such as a ball, or a cylinder, or a cone.

Plate head and/or hood can be designed in the form of a triangle or a quadrant, or a polygon, or a circle.

Volume or flat head and/or hood can be also designed in the form of a stylized flower or heart.

Heads and hoods can be also designed in the other forms suitable for obtaining the indicated technical result.

A head can be detachably mounted on a needle rod.

A free end of the needle rod can be designed sharpened.

A contoured rod can be designed wave-formed.

A contoured rod can be designed with annular projections located at a distance form each other.

A contoured rod can be designed as consisting of polyhedrons.

Notches and hatches can be designed on the contoured rod surface.

A contoured rod can be designed as consisting of conic bodies facing with their apexes toward a free rod end.

A needle head can be connected to a detachable retainer thereof by a protective advantageously flexible connection.

A needle is designed of a material, which is biologically neutral for a patient, for example such as gold, silver or steel alloy.

The proposed needle design provides for an additional action on the auricular acupuncture points that enhances a therapeutic effect obtained due to providing a larger contact area of the article with the skin and weighting the article as well as due to acupressure of the points.

The described designs of heads and hoods allow for enhancing not only exploitation properties thereof but also create conditions for enhancing a pressing effect on the corporal and auricular points contacting therewith.

This is especially manifested in the manufacturing variants of volume heads and hoods, as the pressure on the auricular points is enhanced by the influence of gravity vector that also results in a therapeutic pressing effect, a greater flow of micro pulses entering the hypothalamus, for example the hunger center is better blocked and appetite is better suppressed and the effect on lipolytic mechanisms is enhanced.

One of needle therapy problems consists in that using one needle one cannot affect a greater number of points on a patient's body than that including the needle inlet point and an outlet point thereof, as well as the points located in the projection of the channel formed by the needle rod.

In order to enhance a therapeutic effect obtained in placing a needle, providing additional action on the acupuncture points and/or creating anti-adaptation effect resulting from their action on the predetermined points, which is elimination of habituation to their action, is required in certain cases.

This habituation in needle therapy occurs with regard to the pulses flowing from reflexogenic zones into the brain. With time course, the brain stops recognizing them and the therapy effect is discontinued.

Either a long interval from one month and more, or a change in the needle placement points is required, after which an interval or a rest from this effect is still necessary.

In practice, at the moment of interrupting therapy, pathological symptoms associated with exacerbation of a disease, worsening treatment results and slowing down recovery rate are just manifested.

In order to expand assortment of the proposed devices (needles) providing for enhancement of their exploitation properties, in particular reliability of holding on a patient's body, for example in his or her auricle, as well as to increase the effect range on the remote acupuncture (auricular) point, the designs described below have been developed.

A device for acupuncture reflexotherapy comprises an acupuncture and acupressure members, the acupuncture member being designed in the form of a needle rod, and the acupressure member being designed in the form of a plate or a volume body directly or through a connecting member non-detachably connected to one end of the indicated rod and detachably connected to another end thereof via a retainer.

The volume body can have a round, or a triangle, or a tetragonal, or a polygonal cross section.

A contour can be formed on an external surface of the acupressure device member.

The needle rod can be designed contoured or wave-formed or zigzag-formed.

The rod, the connecting member and the retainer of the device can be designed integrally as one member.

In the point of a non-detachable connection of the rod to the connecting member, at least one spring coil can be formed.

The claimed technical result associated with enhancement of the device holding reliability on a patent's body is achieved in the invention due to that following exposure of the device, a free end of the needle rod is connected through a retainer designed for example in the form of a hook, to the connecting member or directly to the acupressure member, which in its turn is non-detachably connected to the end opposite to the free one of the mentioned rod.

The needle rod located under the skin together with a channel formed therewith represent an original hinge, the acupressure member being capable of turning with respect to the hinge axis for an angle of approximately 180°.

Further turning the acupressure member is limited by a patent's body surface. At the same time, using the proposed device not only the rod introduction and outlet points are affected by pressure with one or several hand fingers, but also the points located in the projection of a channel formed therewith and the remote points and zones of the patient's body located within the reachable zone of the acupuncture member are affected, that is directly associated with the achievement of the technical result of widening the effect range on the remote acupuncture points.

It is appreciated that the less will be the member area affecting these points, the less will be the effect itself.

Therefore, within the frames of the instant solution, the form of manufacturing the acupressure member is proposed to be diversified by manufacturing it in the form of a plate or a volume body having different cross section, on the external surface of which a various contour is proposed to be designed according to the invention variants, for example in the form of blunted pins, which will provide for enhanced effect on the acupuncture points located within the reachable zone of the acupressure member, and accordingly, enhancement of the therapeutic effect obtained resulting from this action.

To this end, the device rod can not obligatory have a straight line form but also any other form suitable for obtaining the claimed result, for example wave-form and zigzag-form, and surface thereof can be designed contoured.

In order to simplify the design, the device members can be designed of a certainly bended integral metallic bar, and the acupressure member can be designed in the form of a hood secured on the connecting member.

In order to enhance convenience of using the device, in the place of a non-detachable connection of the rod to the connecting member, a spring can be formed designed for example in the form of at least one coil of a cylinder spring.

As was already noted, volume and plate head and retainer allow for performing passive and active acupressure using additional pressing with hand fingers during treatment not only within the boundaries of one zone and the needle introduction and outlet points, but also of a channel, wherein the rod is placed.

Massaging the indicated zones, a patient performs stereotypic movements, wherein the effect force and frequency parameters are described by rhythms characteristic of the given person, which rhythms do not in fact change. It is hard to force an individual to perform arrhythmic movements as the human body lives according to regulated rhythms.

The technical task to solving of which the proposed invention was also directed, consisted in the development of the needle design, which would during the use thereof provide for the possibility of creating by a patient chaotic voluntary movements (non-rhythmic, unpredictable and various by parameters) and thereby, anti-adaptation effect from the effect of needles is enhanced.

The set and proposed technical task is resolved due to the following combination of features.

A needle for needle reflexotherapy (acupuncture reflexotherapy), in particular auriculotherapy, consists of a rod with a head, on a free end of which a detachable retainer is mounted, wherein the rod head and/or the retainer is in the form of a hood having a volume, plate or annular shape, and at least one suspension member with a small weight is detachably secured on one or on the both of them.

In the presence of at least two (or more) suspension members in the form of small chains, they can have similar or different length, and the small weights respectively have similar or different weight, the small weight suitably having a flat or a volume form.

On the surface of the head and/or the retainer, at least one pin can be designed to enhance the effect on selected corporal or auricular points.

The mentioned retainer advantageously designed in the form of a hood, has a blind opening.

Volume rod head and/or a hood and/or a small weight can be designed in the form of spatial geometric bodies, such as: a small ball, a cylinder, a cone or a polygon. They can be designed hollow or monolith.

Plate head and/or a hood and/or a small weight can be designed in the form of a triangle, a quadrant, a polygon, or a circle.

Different manufacturing forms of heads, hoods, suspension members and small weights suitable for obtaining the indicated technical result are possible.

In order to facilitate mounting and detachment of suspension members with small weights, the head can be detachably mounted on a needle rod.

A free end of the needle rod is as a rule designed sharpened.

The described designs of heads and hoods with suspension members allow for creating conditions for enhancing pressure effect on the corporal or auricular points contacting therewith.

This is especially manifested in the manufacturing variants of heads, hoods and small weights secured on the suspension members, which are volume and monolithic, as the pressure on the auricular points is enhanced due to the influence of the gravity vector that also results in a therapeutic pressure effect, wherein a greater flow of micro pulses entering the hypothalamus, for example blocking the hunger center and appetite suppression are better achieved and the effect on lipolytic mechanisms is enhanced.

In movement of the head and/or the body, suspension members with small weights create a system of chaotic fluctuations with an amplitude and frequency describable by the random number law.

Adaptation to these pulses, which are not subordinated to stereotypes, is impossible as parameters thereof permanently vary.

This just explains obtaining the technical result associated with the anti-adaptation effect of the proposed device, which allows for accelerating cure of pathological symptoms.

Shape of small weights, length of suspensions, number and disposition thereof are selected experimentally depending on many factors associated with individual characteristics of a patient.

LISTING OF THE FIGURES

The invention is explained with reference to accompanying figures, wherein

FIG. 1 schematically depicts a variant of an assembled needle;

FIG. 2 shows a hood (a magnified cross section);

FIGS. 3 to 11 show certain variants of rods, heads and hoods of needles;

Figure 12:
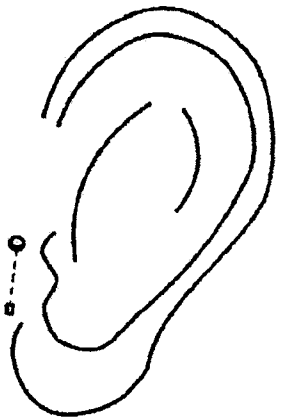
Figure 15:
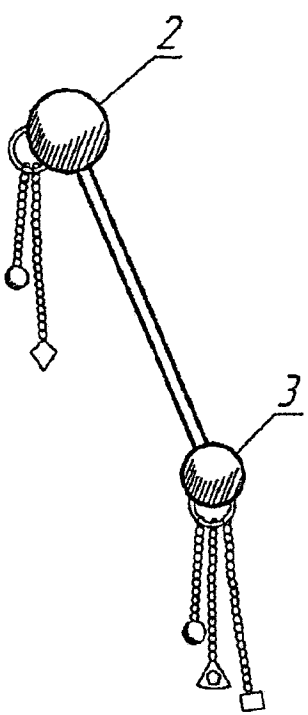
Figure 14:
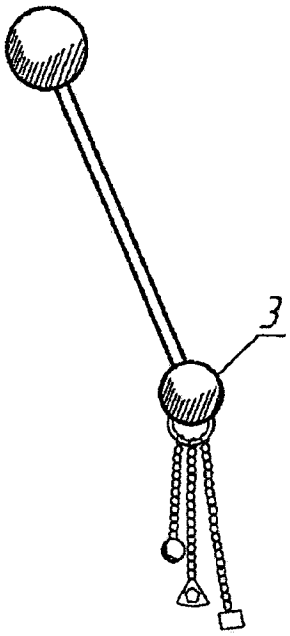
Figure 13:
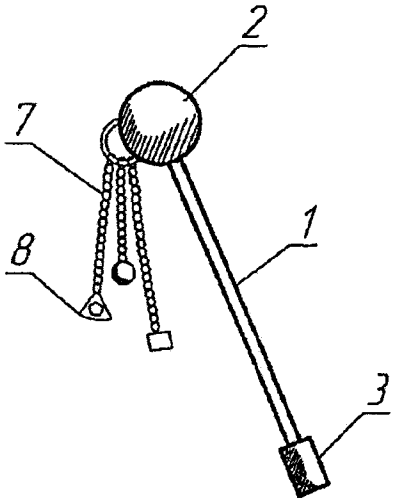
Figure 18:
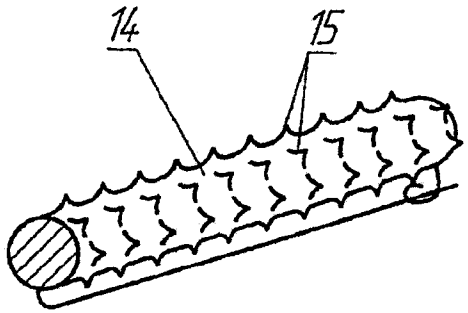
Figure 20:
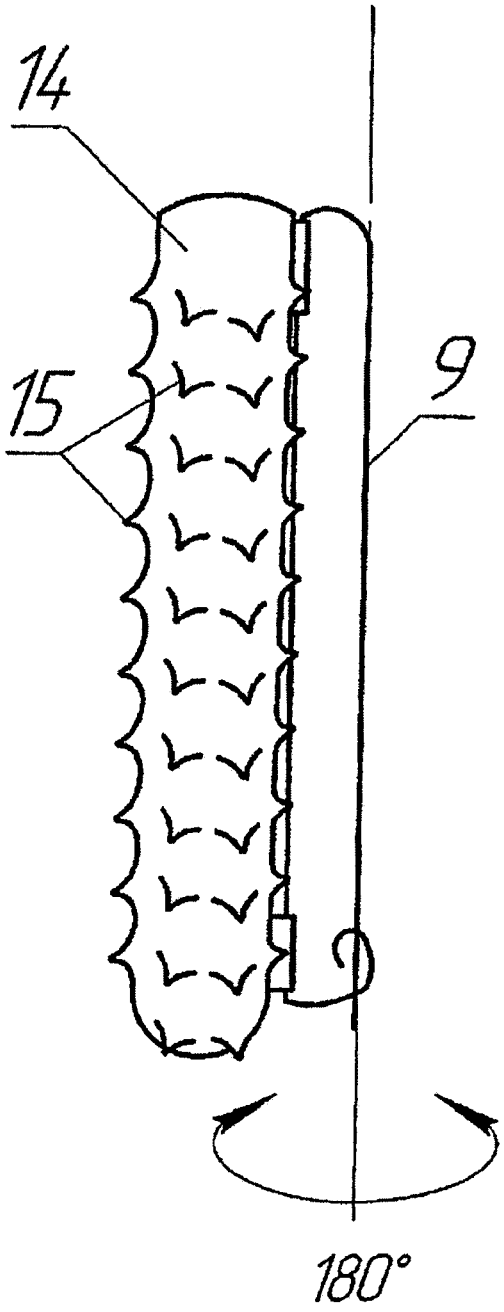

FIG. 12 schematically shows an auricle with a needle introduced therein;

FIGS. 13 to 15 show variants of needles with suspension members;

FIGS. 16 to 19 show variants of devices for acupuncture reflexotherapy;

FIG. 20 shows the device of FIG. 18 (a vertical view);

FIGS. 21 to 24 show variants of needles with non-detachable retainers.

Figure 25:
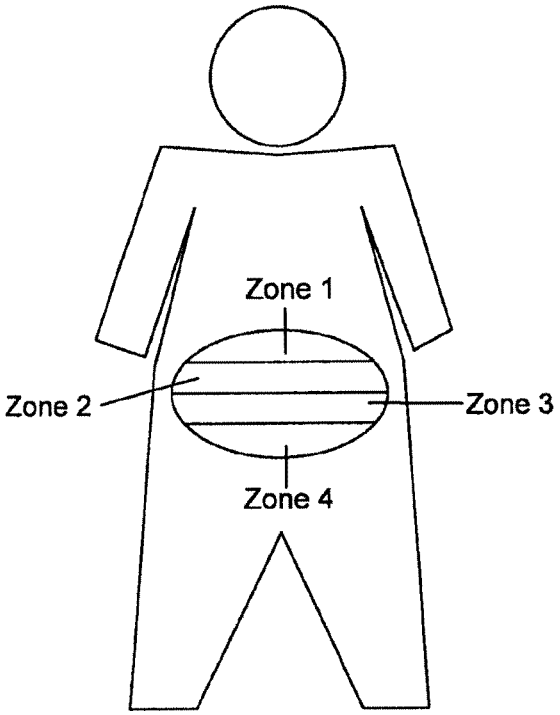
Figure 26:
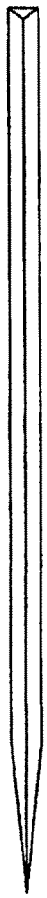

FIG. 25 depicts an exemplanry example of fat deposits divided into zones; and FIG. 26 illustrates an exemplary trihedral acupuncture needle.

The needle depicted in FIG. 1, is designed for introducing into the auricle (FIG. 12) consists of a rod 1, at one end of which a head 2 is rigidly secured, and a second rod end is detachably connected to a lock in the form of a retaining hood 3, wherein a blind opening 4 is designed (FIG. 2) for interaction with the indicated sharpened rod end (fitted in surfaces).

For example, on the surface of a hood 3 one or more pins 5 can be designed intended for contacting a selected point on the body or the auricle to enhance effect thereon.

Different shape variants of manufacturing rod heads and hoods are possible. Thus, FIGS. 3 to 5 present needles with volume hollow or solid heads and hoods in the form of a ball, cone and cube (a polygon), respectively.

FIGS. 6 and 7 present needles with heads and hoods having a plate shape. Thus, FIG. 6 shows a needle with a head and a hood in the form of flat stylized hearts, and FIG. 7 shows a needle with a head in the form of a stylized flower and a hood in the form of a circle.

A rod 1 of a micro needle can be 10 mm long and 0.6 mm in diameter.

A needle rod can be designed smooth and uniform by diameter along all the needle length. The needle tip is slightly sharpened. The needle in introduced into a center of a selected point (an inlet point) and in order to secure it in the auricle (an outlet point) it is fixed with a hood 3, which is put on the side of the needle sharpened tip to a depth of about 1 mm. The hood having the height of 1.5 mm and the diameter of 2 mm, and having a blind opening in the center 4 corresponding to the needle rod diameter (0.6 mm) is designed of an alloy identical to that of the rod.

A device for securing the hood (not shown) is an appliance with a groove having dimensions corresponding to those of the hood 3. The groove can be if different shape depending in the hood shape.

Like the hood, the head 2 in certain embodiment variants of the device can be mounted onto the rod with possible detachment.

Thus, the needle is secured on the body or in the auricle in the inlet point using the head and in the outlet point—using the hood that does not require application of an adhesion plaster.

The needles shown in FIG. 8-11 are characterized by the following parameters.

The needle rod 1 can be 5-100 mm long and can be 0.1-6 mm in diameter.

The needle is introduced into a center of a selected point (the inlet point) and for securing it in the auricle (the outlet point) it is fixed with the hood 3 put on the sharpened side of the needle to a depth of about 1 mm. The 0.15-15 mm high hood is designed of the same alloy that the rod and has a diameter of 0.2-20 mm, with a blind or through opening in the center 4 corresponding to the needle rod 0.1-6 mm in diameter.

In smaller dimensions and weight of the needle including components thereof, the reflexogenic effect degree will be so insignificant that flow of pulses will not be recognized by the hypothalamic neurons and thus, therapeutic effect will be absent.

Just the given parameters allow for preventively realizing a good needle engraftment, overcoming the rejection mechanism of the needle by the body with a sufficient channel epithelization wherein loaded designs are then introduced.

Advantage of the proposed needle with a hood over the closest analogue is the possibility of leaving it in the auricle for a prolonged term (from 30 to 720 days) that is necessary for efficient correction of the body excessive weight. The needle does not require continuous supervision by a physician, and due to manufacturing forms of heads and retainers having no connections, probability of spontaneous withdrawal of the needle by a patient and traumatization with subsequent formation of scar deformity is lowered as well as cutaneous maceration events under adhesive plaster and inflammation are also absent.

The needle rod 1 can also have different shape and contour or it can be designed straight-lined with a smooth surface as is shown in FIG. 1.

Figure 10:
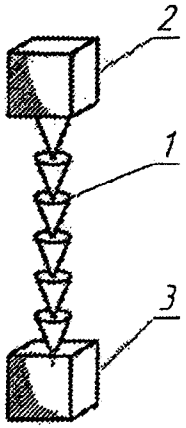
Figure 9:
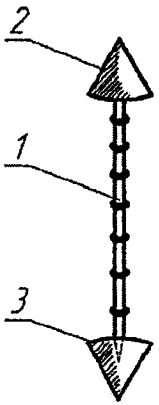
Figure 8:
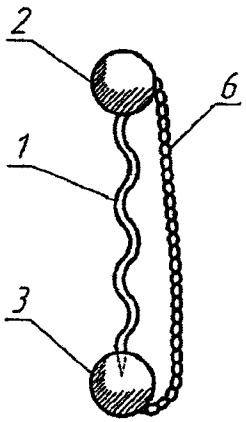

Thus, FIG. 8 shows a needle with a rod having a wave-form shape, FIG. 9 shows a needle rod designed straight-lined with annular projections soldered thereon at equal distances from each other. FIG. 10 shows a needle, a rod of which consists of conic projections, the apexes of which are directed toward a hood.

In order to prevent loss of the detachable hood 3, it is secured to the head 2 using, for example, the chain 6 (FIG. 8).

Figure 11:
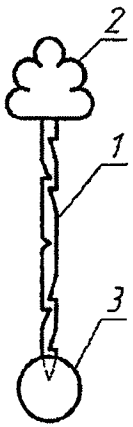

FIG. 11 shows a needle, a rod surface of which is designed with cuts.

As is shown in FIG. 13, for example on the surface of the head 2 a number of suspension members 7 of different length with small weights 8 having different shape and weight can be secured; on the surface of these suspension members several pins can be formed (not shown) designed for contacting a selected remote point(s) on the body or the auricle of a patient to provide for the action thereon.

Different variants of making heads, rods, weight and hoods are possible. Different variants of securing suspension members are also possible. Thus, FIGS. 14 and 15 present needles with volume and monolith heads and ball-shaped hoods, on one of which suspension members with small weights are secured on the hood 3, and, on the other, they are secured on the head 2 and the hood 3, respectively.

Thus, for example, in treating obesity, a needle is fixed in a patient's auricle in the inlet point AP17 by using a head, and in the outlet point AP18—by using a hood. Active pressure in the point AP55 (shen'-men') is carried out simultaneously by using a volume weight with a pin in order to enhance synthesis of endorphins to improve psycho-emotional state of the patient.

In addition to treating a main disease, a needle design allows for achieving treatment of concurrent diseases without utilization of additional appliances.

In the embodiment variant of a device for acupuncture reflexotherapy, which is preferable in view of simplicity thereof (FIG. 16), it consists of the rod with a sharpened end in the form of the needle 9, the connecting member 10 and the retainer (catch) in the form of a hook 11 (the device is shown in a disconnected view).

Figure 17:
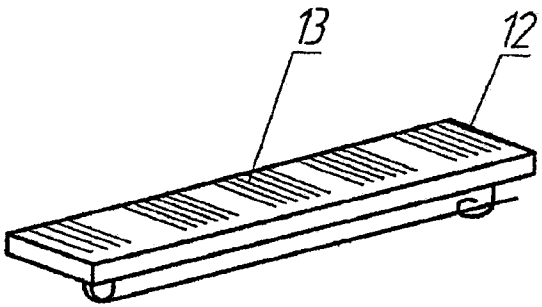
Figure 16:
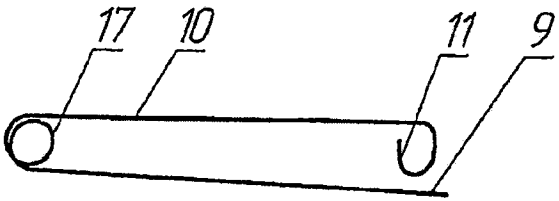

FIG. 17 shows the device of FIG. 16 on the connecting member of which an acupressure hood member in the form of a plate 12 is secured, which plate has a rectangular cross section and a smooth surface, but making a plate with a cross-section of a different shape for example oval, is possible. The contour 13 in the form of ribs or pins can be also designed on the plate including lateral long sides thereof.

FIG. 18 shows an acupressure member designed in the form of the volume body 14 with the blunted pins 15 chaotically or regularly distributed by the surface thereof.

Figure 19:
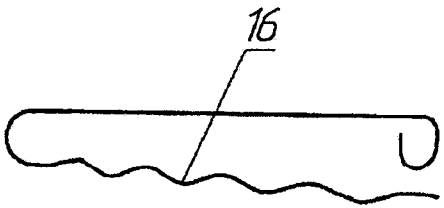

FIG. 19 shows a device variant with the wave-shaped pin 16 intended for stimulating points located in a zone of passage thereof.

The spring coil 17 can be designed in the connection place of the joining member with the rod end (FIG. 16).

The device is designed of any material that is biologically neutral for a patient, for example gold, silver, silver or steel alloy or of a durable plastic.

The device is used as follows.

Inlet and outlet points of a device rod needle are topographically determined, a respective patent's skin region is disinfected and the device is exposed by passing the device rod through the inlet point, for example AP17 and the outlet point AP18. During carriage of the device (from 3 days up to 6 months and more), a patient turns the acupressure member with a hand fingers to one or another side (turning to a 180° angle is possible) and presses it that results in stimulation of the points located in the device reach zone, and provides for both passive and active acupressure and respective additional therapeutic effect (FIG. 20).

Figure 22:
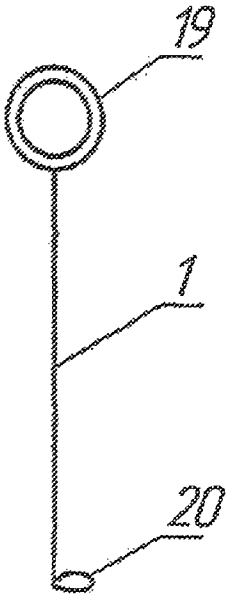
Figure 21:
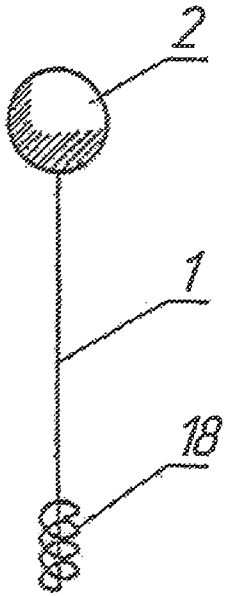

The invention is also explained by the figure, wherein FIG. 21 shows a needle variant with a retainer in the form of a bended needle end wound onto the rod; FIG. 22 shows a needle variant with a retainer in the form of a needle end convoluted into a tangle.

Each of the needle variants shown in FIG. 21-24 designed for example for introduction into the auricle, consists of the rod 1, at one end of which the head 2 is for example rigidly secured, and a second rod end is designed with a possible formation from it of a retainer in the form of the catch 18.

One or more pins (not shown) can be designed on the surface of the head 2 and/or the catch-retainer 18, which pins are designed for contacting a selected point(s) on the patent's body and the auricle in order to enhance the effect thereon.

Various variants of making rod heads and retainers are possible. Thus, FIG. 21 presents a needle with a volume hollow or monolith head in the form of the ball 2, a catch-retainer in the form of the bended end 18 thereof wound onto the rod 1. FIG. 22 shows the head in the form of the annular member 19, and the catch-retainer is depicted in the form of the coil turn 20 (forming several coil turns is possible).

Figure 23:
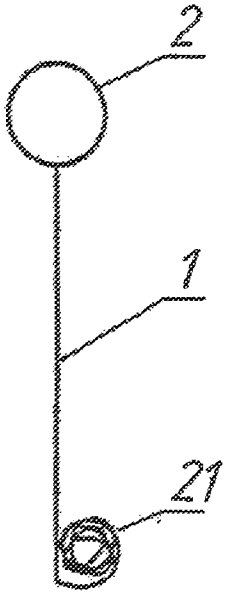

FIG. 23 presents a needle with the head 2 having a plate shape, and the catch-retainer in the form of the tangle 21.

In order to provide for forming a retainer of a needle rod free end, the whole rod or a terminal position (a tip) thereof is designed of a material having plastic properties, such as for example: alloy of gold, silver, alloyed steel.

Making not the whole rod but only a terminal portion thereof of a metal alloy having shape memory, for example Ti Ni, is also possible.

Figure 24:
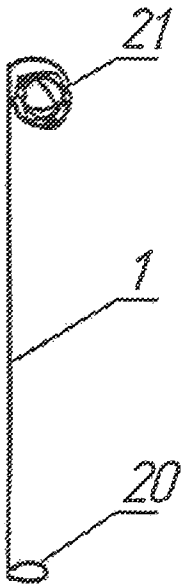

The needle variant shown in FIG. 24, is characterized by that the both terminal positions of the rod 1 are designed with the possibility of forming retainers therefrom, for example in the form of a single coil turn 20 at one end of the rod, and the tangle 21 at the other end thereof.

The needle is introduced into a center of a selected point (an inlet point) and to secure it in the auricle (an outlet point) it is fixed by the bended free end of the rod.

Forceps or other similar appliances can serve as a device for forming a retainer at the needle end.

The head 2 in certain embodiment variants of the device can be detachably mounted on the rod.

Thus, the needle is fixed on the body or in the outlet point of the auricle by using the head or the retainer in the form of the bended rod end, and in the outlet point using the catch-retainer in the form of the bended rod end.

The listed variants of needles are advantageously designed of the alloy useful for making golden rings, which alloy consists of 75% gold, 13% silver and 12% copper, but they can be also designed of any material, which is biologically neutral for a patient.

Advantage of the proposed needle with a non-detachable retainer is the possibility of leaving it in the auricle for a long term (from 30 days to 360 days and in certain cases up to three years) that is necessary, for example, to correct an excessive body weight. The needle does not require a permanent observation by a physician, and there is no probability of voluntary withdrawal thereof by a patient and traumatization with subsequent formation of a scar deformity. Following completion of the procedure, the needle tip(s) formed as a retainer(s) are cut off by pincers and the needle is withdrawn from the patient skin.

The claimed technical result for "a method" subject matter is formed in three stages and intensity thereof grows on in a cascade progradiently correlating with physiological processes occurring in histological media in the needle puncture site by a threading method. Just at the moment of the needle introduction itself, formation of a primary pulse flow is known to occur. As a result of the instant effect, just in introduction of the needle by threading, secondary pulse flows are formed, which are more powerful, permanent and prolonged. Under the term "prolonged", especially sustained processes occurring in histological media as a result of the needle introduction into the inlet point and withdrawal thereof from the outlet point are meant. In the known sources, the terms of usual pricking and the processes associated with a primary effect are presented (in the article by Kokhanovich et al.—2 days, in the Barashkov's book—several hours). In the proposed method obtaining the therapeutic effect for 90 days is provided without withdrawal of the needle or, for example in treating obesity—up to 3 years. These flows of secondary pulses from the reflexogenic zone are caused by physiological processes occurring in tissues. Processes in tissues are classified in three stages and the pulses emerging at each step are subdivided into three orders.

Stage 1—Epithelization of an acupuncture channel. Up to 30 days.

As a result of threading two points with one needle, an acupuncture channel is created with two openings: an inlet point and an outlet point, and between them, a space is formed by the needle. According to the regeneration laws, epithelization forming an epithelized channel begins in tissues around the needle. In the process of growing on epithelium in the course of a gradual and sustained epithelization, cellular receptors generate a powerful flow of the first order secondary pulses from a reflexogenic zone into subcortical centers of the hypothalamic-pituitary system that enhances therapeutic effect of the given exposure.

In particular, in treating obesity an inhibition focus in the hypothalamic hanger center is faster generated and lipolytic mechanisms are activated, and as a sequence, a more intensive body weight decrease occurs. In treating arterial hypertension, afferent pulses enhance angiosuppressory effect in the hypothalamus vasomotor center, and arterial pressure is faster normalized. In case of treating allergy, the activity of antihistamine mechanisms, which faster control allergic reaction, is enhanced.

For patients with a longer history and a pronounced disease degree who require a longer exposure to acupuncture stimulation (from one to several months), an important therapeutic moment is exposure of selected points to the second order secondary pulses produced at step 2.

Stage 2—Regeneration of the acupuncture channel On completion of the acupuncture channel epithelization, the channel surface becomes covered by multiplayer squamous cornificating epithelium, epidermis, an external cellular layer of which is gradually desquamated. Epidermis renewal occurs due to a deep germinal layer (see Borzyak E. I. "Anatomija cheloveka" (Human anatomy), vol. 2, Moscow "Meditsina" publishers, 1987, p. 469). The given regeneration process of epidermis cells is a potent stimulant of exteroceptors transforming stimulation energy into nervous pulses determining a powerful flow of neurogenic afferent pulsation (see Borzyak E. I. "Anatomija cheloveka" (Human anatomy), vol. 2, Moscow "Meditsina" publishers, 1987, p. 290) into cerebral nuclei.

According to the reflex theory generally accepted in medicine, the more pulses come from periphery the more pronounced are processes in the central structures, i.e. gangliar nodes, subcortical brain centers. Thus, the second order secondary pulsation promotes enhancement of therapeutic effect.

Stage 3—Intra-Channel Extumeation (Ex-Tumeo—to Swell (Latin))

In leaving a needle in the acupuncture channel for a term of from four months and longer, desquamated epidermis cells, neutrophils and macrophags and dead bacteria are accumulated in the channel lumen. In practice, in the needle withdrawal at this step, a whitish deposit can be seen; and sometimes this deposit in the form of a rod is spontaneously extracted with a pad pressed to the external channel wall. At the same time, the process is not inflammatory as it is not accompanied by hyperemia, pain, edema and other signs of inflammation. This is a natural accumulation process of utilized organelles, cells and other vital activity products of microorganisms. The given filling the acupuncture channel with vital activity products of tissue structures creates pressure to internal walls with expanding effect, and the longer the needle is in the channel, the greater amount of the channel content is formed, the more pronounced is passive pressor pulsing. These pulses are classified as the third order secondary pulses. They promote maintaining a dominant formed at previous steps as well as enhance a therapeutic effect.

In the proposed invention, a zone of exposure to a needle is not limited only by a rod thickness of the needle itself, as in the exposure zone, the points are included, which are topographically located in the rod needle passage site, for example hypotensive groove (AP105) (see Example 2).

In the proposed solution variant, the needle retention reliability is provided by the use of a non-detachable retainer, which secures the needle, but the needle is introduced into one point and comes out from another one, thus connecting two and more points, which are connected by the channel formed by the needle rod.

EXAMPLES OF THE INVENTION EMBODIMENT

The following clinical examples on different nosologies are presented to support embodiment of the proposed method for a prolonged effect.

EXAMPLE 1

Treatment of Allergy

Female patient I., 23 years; diagnosis: polynosis (allergy to birch pollen) attended a doctor complaining of running eyes, sharp ocular pain, rhinitis, cough. She was examined by an allergologist. Diagnosis: Acute vasomotor nasopharingitis with positive allergic tests for birch pollen.

She had a history of annual exacerbation every spring. Efficacy of antihistamine drugs was low, and they also cause somnolence and are contraindicated in driving that limits actions of the patient.

Objectively: The patent's condition was satisfactory. The signs of conjunctival and scleral hyperemia and extensive colorless nasal discharge were observed; the patient was permanently wiping her nose with a handkerchief that resulted in a pronounced maceration and edema of the wings of nose; she had a dry cough.

The following treatment was carried out:

In the projection of the allergic groove (AP71—the urticaria point), two representative points were determined, one of which was a needle inlet point, and the other was the needle outlet point; into these points a needle was introduced using threading method, i.e. the needle was introduced through one and extracted through another point on the skin surface, and it was secured by a head and a retainer designed in the form of a free needle end bended into a coil. The needle was left for 60 days. Examination at 60 days showed disappearance of exudative rhinitis, absence of conjunctivitis and other signs of allergic reaction. The needle was withdrawn by cutting off the end thereof bended into a coil using pincers and removal the other end thereof with the head from the channel.

EXAMPLE 2

Treatment of Essential Hypertension

Female patient S., 45 years, complained of elevated arterial pressure, frequent headaches, shortness of breath, often crisis conditions with nausea and vomiting. Anti-hypertensive drugs were contraindicated because of a polyvalent drug allergy.

Objectively: A medium grave condition. Arterial pressure was 200/100 mm Hg, respiration frequency was 30 cycles per minute, pulse rate was 90 per minute, the lower extremities were pasty. Ophthalmologist's examination reveled changes in the ocular fundus corresponding to grade 3 hypertension.

Diagnosis: Grade 3 essential hypertension. Grade 1-2 cardiovascular insufficiency.

The following treatment was carried out:

In the auricular point AP105 (the point lowering blood pressure) also called as hypotensive groove, occupying all the upper third of the auricular back surface sulcus, two of the most representative points of one groove were determined, one of which was a needle inlet point, and the other was the needle outlet point; into these points a needle was introduced using threading method, i.e. the needle introduced through one and extracted through another point of the skin surface and it was secured by a retainer designed by forming a coil turn from a free needle end. The needle was left for 90 days.

Examination at 90 days showed as follows: the patient's state was satisfactory, lowering arterial pressure down to 160/90 mm Hg, pulse rate 80 per minute, respiration rat 20 cycles per minute and significantly diminished pastiness of the extremities were observed.

EXAMPLE 3

Lumbago Treatment

Patent p., aged 48 years, complained of a sudden extremely sharp pain deep in the lumbar region provoked by lifting a load. Objectively: a forced posture fixed at the attack moment with the trunk bended forward was observed; a pronounced tension of lumbar muscles was felt in palpation. Defence was aggravated by tenderness of the interspinous ligament. Spasm of the right paravertebral muscles was seen. A radiogram of the spine lumbar section showed the signs of spondylolystesis of the lumbar 1-11 vertebra.

The following treatment was carried out:

The corporal points V22 (san'-tszyao-shu) and V51 (khuan'-men') were topographically determined to the right from spinal processes, then a needle was introduced into the point V22 by threading, and the point 51 was the exit place. Further, a retainer was used at the needle end designed by winding the bended needle end around the free rod site adjacent thereto. The needle was introduced for two days.

Examination was scheduled at 2 days. Objectively: a normal carriage was restored, pain syndrome disappeared, palpation of the L1-11 zone was painless. Lumbago was cured.

In treating obesity, different shapes of a needle rod are possible which shapes allow for enhancing efficacy of affecting auricular points indicated for neurosensory-humoral regulation of the hypothalamus-pituitary system and for optimizing lipolytic mechanisms. Puncture of the adrenal representative points located in a needle rod projection zone, and active pressure thereof limits synthesis of catecholamines, which are contra-insular hormones and cause progradient blood glucose (deposited in the form of glycogen) level elevation that is perceived by the hypothalamus chemoreceptors and inhibits activity of the appetite center neurons.

Furthermore, catecholamines enhance lipid catabolism, that is lipolytic mechanisms, which are important for lowering an excessive body weight.

Affecting the auricular acupressure points using the proposed needle designs, allows for performing the both passive and active acupressure of these points in order to enhance reflexogenic zonal stimulation and to prevent adaptation in contrast to the closest analogue wherein transposition of a needle into the other auricle only partially resumes the effect for a short time, but the very fact that the needle is transposed on the already inactive auricle, influences power degree of this effect and does not provide for a proper intensity thereof.

Since treating obesity requires a long time period, adaptation to reflexogenic effect can be surmounted by subjecting zones of acupuncture points to an additional apparatus stimulation using the known physical factors. The said factors include not only digital pressure, but also short-wave (by means of the "KVCh" or "Yav'" apparatus), micro wave (the "Porog" apparatus), laser (the "UZOR" apparatus), electromagnetic (the "AMRT" apparatus), thermal (wormwood cigarettes) and other therapies.

Also, due to the proposed method and needle designs the possibility appears of procedure-by-procedure correcting force and orientation of refectory action by selection, and namely, substitution of a head or/and a retainer and/or a needle rod of light hollow shapes with heavier monolith shapes, or those loaded by a suspension with weight, substitution of plate shapes with volume ones; those having even surfaces with those having irregularities, contour and/or pins, leaving them for a term of from 60 to 720 days being guided by objective data (decrease in the body weight and volumes) and subjective data (appetite blocking degree) in a patient as well as by a needle exposition time, by applying an individual approach.

Furthermore, similarly to the most relevant prior art document, using one needle simultaneously for two auricular points and securing it with a retainer, allows for leaving the needle for a long time simultaneously in two points that provides for a sustained blocking the hunger center and for elaborating a food reflex taking into consideration a patient's individual peculiarities; this lowers traumatization and a possible infection.

Encompassing all the fat depots allows for not only lowering the body weight but also for correcting the body.

Using a deep digital massage of a fat depot zones improves a local blood flow, optimizes lymph flow, decreases edema and tenderness of tissues as well as promotes a general relaxation and relieving stress in patients. And additional use of massaging biologically active points allows for enhancing action thereof due to the both local effect resulting from action to a given zone points, and due to a general effect through association thereof with the parts of the central nervous system.

The use of an acupuncture needle in affecting fat depots with destruction of their adipose tissue enhances efficacy of therapy course, allows for correcting the body at the same time lowering the number of procedures effecting sites of an excessive fat deposition and providing the absence of sagging folds. And the use of a three-edged needle enhances efficacy of treatment, especially in patients with a large obesity degree.

Therapy of concurrent diseases allows for enhancing efficacy of obesity treatment.

The method is realized in the following way.

An auricle for introducing a needle is first determined. Any auricle may be first treated. In a number of cases, in a long term of obesity and a history of treatment using different kinds of reflexotherapy, it is appropriate to begin effecting from an active auricle.

Two auricular points for example AP17 and AP18, are found on the selected auricle. A needle with a head at one end is introduced into one of the indicated points, which needle is then drawn out from the other indicated point by conducting under the skin. The needle introduced into the auricular points in this way, is secured by retainer, and depending on obesity stage, a patient's condition, time course of weight lowering, it is left for 60 to 720 days. A needle of a gold alloy, as well as silver needles, steel needles or needles manufactured of any materials biologically neutral for a patient, can be used.

The therapy is commenced from flat (plate) needle forms substituting them for heavier and more volume needles, at the same time using an additional effect of a rough surface or having a surface equipped with the pins or a retainer thereof allowing for enhancing the effect on the selected auricular points by periodical pressing with a hand fingers.

Thus, in slowing down the body weight lowering time course, 45-60 days post the treatment commencement, at the second step thereof substitution of the plate head of a needle with a volume hollow one is carried out, and appetite appearance, digital or apparatus stimulation conducted for example by mechanical pressing the head and/or the needle retainer is recommended.

At the following 45 to 60 days, during the next treatment step, the flat (plate) retainer is substituted for a hollow, volume one. Corpometric control is simultaneously carried out.

Then, at a certain time (from 45 to 60 days), the head and/or the retainer are substituted for the monolith ones.

Substitution of the head and/or the retainer having an even surface for the same by shape (hollow or monolith) head and/or the retainer but having unevenness or pins on the surface thereof adjacent to a reflexogenic zone is also possible. At the same time, in appearance of appetite or thirst, digital or apparatus stimulation of respective points is also carried out.

It follows from the aforesaid that a step-by-step weighting the needle, in which the gravity vector of the head and/or retainer thereof, as well as a step-by-step substitution of a flat head and/or retainer for volume head and retainer including those, at the surface of which facing to the acupressure ones, are designed with unevenness or pins, is summed, belong to a passive stimulation of the auricular points.

Active stimulation (acupressure) is achieved by digital pressing on the volume needle elements (the head and/or the retainer) located in the projection of the auricular points, by a patient himself, and due to that, entering micro pulses from the receptors into the hypothalamus is enhanced that results in increase in inhibition dominant of the hunger center as well as in the central lipolytic mechanisms optimizing lipid metabolism.

As a result of embodying the proposed method, lowering weight from 4 to 10-20 kg depending on the initial body weight excess, was achieved between the treatment steps mentioned above.

If a patient has concurrent diseases, then into the AP selected taking into consideration the concurrent patient's diseases, needles are additionally introduced. At the same time, needles into the auricular point intended for treating concurrent diseases are introduced daily or every other day using a course of 8 to 10 procedures.

Following introduction and securing a needle in the selected auricular points at step one, additional effect on fat depots located in different body regions of patients is possible. Patients especially men with fat depot location on the abdomen are most often encountered. In a number of cases, fat depots may be simultaneously located in several regions, for example on the abdomen, tights and buttocks. Women are more often worried about excessive fat deposition on the neck, extremities and abdomen.

One of fat depots, most often, which is prevalent in a given patient, is first subjected to the action. Fat depots are affected, which may be located on the abdomen, chest, tights, buttocks, lateral trunk surfaces, extremities, neck and face. During one procedure, one fat depot of a patient is affected. Extensive fat depots, such as the abdomen depot, are mentally or using a cotton ball soaked with iodine are divided into several zones and treated sequentially by zones as is shown in FIG. 25.

One of the selected fat depot zones is first affected. To this end, the selected zone is first affected by a deep digital massage. In addition, biologically active points (BAP) located in the given zone of a fat depot may also be affected by a deep digital massage using such massage procedures as vibration, kneading, pressing. A total massage time is from 5 to 10 minutes. It allows one to significantly improve local blood flow, optimize lymph flow, decrease edema and tenderness of tissues that exerts a positive effect on lipid metabolism enhancement and normalization thereof. Massage also promotes a general relaxation and relieving stress in patients and prepares the zone for subjecting to the effect of a three-surfaced acupuncture needle.

Then a fat depot is subjected to the effect of introducing acupuncture needles. To this end, a fat fold is fixed with one hand, and with the other hand, an acupuncture needle is repeatedly introduced into the same fold turning it around its axis; adipose tissue is wound on it and then, the needle with an adipose tissue wound thereon, is withdrawn by a sharp movement. In case of a significant obesity degree, a three-edged acupuncture needle may be introduced. Depending on the fold location site, a needle may be introduced either perpendicular to a treated surface in the given fat depot zone, or at an angle thereto. All zones of a selected fat depot are treated during one procedure.

A next fat depot is subjected to treatment in 10 to 60 days. This period between the effects on fat depots depends on the both a patient condition, his obesity degree and on the number of the patient's fat depots and his weight lowering time course during the procedures.

When carrying out the proposed method, patients noted a more pronounced blocking appetite and thirst, a reedier overcoming symptoms associated with entering lipolization products and acetone bodies causing headaches, ketonemia and acetonemia, into blood, as compared to the known method (see the most relevant prior art document).

This effect is explained by generating a greater pulse flow entering the hypothalamus due to the proposed method that results in a significant decrease in autonomic failure occurring in cascade in the known method.

Lacking possibility of symptomatic correction of reflexogenic effect force and direction in the known method (see the most relevant prior art document), is resolved according to the proposed method by a selective enhancement of accentuated pressure on the point of either thirst or hunger, using a plate or a volume head and/or a retainer, onto one or another zone depending on an objective or subjective patient's state.

Due to the proposed method, in a more intensive weight loss, patients preserve a better state of health, working ability and a comfortable psycho-emotional state.

Embodiment of the method is supported by the following clinical examples.

EXAMPLE 4

Female patient V., 48 years. Beginning from the second delivery, she complained of the constantly increasing body weight, pains in knee and hip joints, edemas, shortness of breathe in walking and discomfort in the heart region.

She had a history of increase body mass for 23 years. All attempts to decrease the body weight had practically no results. An unsteady weight decrease by 10 kg in using Tai tabletted anorexic drugs with a subsequent nutritional failure and a weight gain relapse of more than the previous one, were observed.

Satisfactory condition, usual coloring and cleanness of the skin were objectively observed. The patient was overweight, excessive fat deposition with prevailing gluteo-femoral localization of fat depots was seen. The patient's height was 150 cm, she weighted 90 kg. BWI was 40 conditional units that corresponded to degree 3 obesity.

Ultrasound examination data: the signs of left ventricular hypertrophy was revealed.

ECG: sinus rhythm, tachycardia, horizontal position of the heart electric axis, a pathological Q wave in lead III not confirmed in the AVF lead and disappearing at inhaling. T wave depression was noted. AP was 160/100 mm Hg, pulse rate was 98 per one minute. Respiration rate –28 per one minute.

Treatment using the proposed method was carried out. In determining an active auricle, which in the given patient proved to be the right one, a needle was introduced into the point AP17, the end of which was drawn out through the point AP18, the needle having a plate-shaped head.

45 days later, her body weight was 75 kg. The time course of the body weight decrease was 15 kg. A general condition improved, edemas of the lower extremities disappeared. Enhanced appetite was subjectively noted. During the procedure, in the patient, the plate needle was substituted for a volume one. Due to a passive acupressure, adaptation was surmounted in 3 days, and the patient reported a decreased appetite.

60 days later, decrease in the body weight was 12 kg more making up 63 kg. Objective data: shortness of breath has disappeared (respiration rate was 20 per one minute), blood pressure normalized down to 120/80 mm Hg, pulse rate was 80 per one minute. The patient subjectively noted increase in thirst against the background of a good health condition (in consumption of the same liquid amount, i.e., 2 liters daily). At the moment of a procedure, the retainer was substituted for a volume ball on the representative thirst point AP18. Active acupressure for 30 seconds was recommended in appearance of thirst. Adaptation of the AP18 point was surmounted for 24 hours.

At this step, a usual hood was substituted for a plate or a volume one with an even surface (pins), and a head with an even surface (pins) was also used.

The next examination at 55 days, showed decrease in the body weight by 10 kg. The patient was in a satisfactory condition. Cutaneous teguments were clean, acrocyanosis disappeared. ECG parameters were normalized. Subjective signs were as follows: a head and a retainer were enhanced salivation and "sucking" in the gastric region. At the needle therapy procedure, a head and a retainer were substituted for flat ones having unevenness. Digital pressure of the head and/or the hood was prescribed in excessive salivation and discomfort in the epygastrium till disappearance of the given symptoms.

58 days later, time course of the body weight lowering was 13 kg more. A total weight decrease for the treatment course was 40 kg. The corpometry data were as follows: height 150 cm, weight 50 kg. Body weight index (BWI) or (Ketle index) $BWI=m/L^2$ (m)=50/2.25=22.2 conditional units that corresponds to a normal body weight (the BWI parameters from 18.5 to 24.9 conditional units—the normal range). Objective data were as follows: cutaneous teguments were clean, the nasolabial triangle cyanosis was absent. Pulse rate was 72 per one minute. Respiration rate was 18 per one minute; ECG—sinus rhythm, normal position of the heart electric axis, disappearance of the pathological Q wave in lead III; according to ultrasonography data left ventricular hypertrophy has disappeared. In using the LOBBY techniques, decrease in internal discomfort and stress, harmonic type of attitude to the disease were observed that itself was a sign of the occurred psycho-emotional sphere correction, self confidence, broadening circle of interests as well as easiness of establishing interpersonal relations. Enhanced mood and working capacity were subjectively noted.

EXAMPLE 5

Female patent A., 35 years. Attended the clinic for treating an excessive body weight using the "ORIGITEA" method according to the present invention.

Height 170 cm, weight 95 kg. A procedure according to the standard prescription was carried out that resulted in the weight decrease down to 90 kg.

One and a half month later, the patient noted a certain appetite enhancement. A procedure of enhancing afferent pulses sent from the reflexogenic zone on the auricle was carried out. Pulse currents were generated using the "Delta 101" apparatus when terminals for connecting wires were directly connected to a needle (cathode) and the zone of the contralateral tragus (anode). Electric stimulation lasted 20 minutes for three days in succession. A range and frequency of pulses were selected until distinct sensations appeared but not painful ones and resembling vibration and their frequency was 80-100 Hz and current 2-8 mA.

The patient's condition improved, her appetite sharply decreased, and her mood improved. One month later, her weight decreased by 4 kg and it was 86 kg. The patient reported discomfort in the epygastrium. She was objectively diagnosed as having exacerbation of chronic gastritis. Adaptation to the needle effect in the points AP 17, 18, which are connected with the nervus vagus (the vagal nerve) nuclei, was a triggering factor and blocked gastric juice and pancreatic juice secretion. Because of the history of chronic gastritis and loss of the blocking effect of the points indicated above, secretory activity of the gastric mucosa increased and discomfort appeared.

The patient was exposed to alternating magnetic field having frequency 13.56 MHz using the IKV-4" apparatus.

An inductor of 6 cm in diameter having power of 30 Wt with a gap 1 cm from the patient's tragus surface was positioned on a holder on a regimen switcher 1-3 (a weak thermal intensity); a procedure time was 20 minutes. A course consisted of five procedures.

Objective data were as follows: the patient's condition was satisfactory, she did not complain of epygastric discomfort.

The patient A. successfully continued the therapy course. One and a half month later her weight decreased by 7 kg and was 79 kg.

The patent complained of a sharp increase in spontaneous salivation, which was occasionally provoked by food odor. The given symptoms manifested the adaptation syndrome to the reflexogenic effect.

Laser radiation was used. Flow density power was up to 75 $mWt/cm^2$, and oscillations had wavelength 0.63 μm. The fields were irradiated in the puncture site in the auricular tragus points for 10 minutes in the regimen 4 mWt/cm using the "UZOR" apparatus. Two procedures were conducted every second day.

The patient stopped complaining of salivation immediately after a second procedure.

One and a half month later, her body weight decreased by 6 kg and it was 74 kg.

The patient A was worried about newly enhanced appetite. Five procedures of a short-wave frequency therapy in the short-wave range were carried out using the "KVCh-ND" apparatus in the regimen 7.1; 5.6; 7.1; 5.6; 5.6 every second day.

The patient again feels a normal appetite level.

One and a half month later, the patient's body weight was 69 kg. An ideal body weight was achieved at the height 170 cm.

The invention claimed is:

1. A method for reducing excessive body weight comprising:

introducing a free end of a needle into a first auricular acupuncture point on a patient's body known to produce weight loss, the needle having a head and a rod and the head being disposed on the rod at a first end of the rod opposite the free end of the needle;

drawing the needle under the skin, and projecting the free end out of the skin at a second auricular point;

securing the needle in this position by a retainer mounted at the free end of the needle;

selecting first and second stimulating parameters, wherein each parameter is selected to induce weight loss;

changing the intensity of the first stimulating parameter on the first and second auricular acupuncture points to induce weight loss by increasing the size of the head, rod, or retainer after a first predetermined number of days; and changing the intensity of the second stimulating parameter on the first and second auricular acupuncture points to induce weight loss by increasing the weight of the head, rod, or retainer after a second predetermined number of days.

2. The method according to claim 1, wherein the needle is left in the first and second auricular acupuncture points for the term of 60 to 720 days.

3. The method according to claim 1, further comprising withdrawing the needle from the first auricular acupuncture point and introducing the needle into a third auricular acupuncture point.

4. The method according to claim 1, further comprising introducing a second needle into a third auricular acupuncture point.

5. The method according to claim 1, further comprising introducing a second needle into a third auricular acupuncture point known to treat concurrent diseases.

6. The method according to claim 1, further comprising dividing a fat deposit of the patient into zones, applying a deep digital massage with a predetermined time interval to a first zone, fixing a fat fold within the first zone and introducing an acupuncture needle into the fat deposit, wounding adipose tissue on the needle by repeatedly turning the needle around its axis, and withdrawing the needle and the adipose tissue wound thereon.

7. The method according to claim 6, wherein the deep digital massage includes massaging biologically active points located in the first zone, and the massaging is done by vibration and/or kneading, and/or pressing.

8. The method according to any one of claims 6 and 7, wherein the deep digital massaging is carried out for 5 to 10 minutes.

9. The method according to claim 6, wherein the acupuncture needle is introduced into the fat fold perpendicular or at an angle to the fat deposit zone surface.

10. The method according to claim 6, wherein the acupuncture needle is a trihedral needle.

11. The method according to claim 6, wherein one treatment of the fat deposit is carried out, and the time interval during the treatment is from 10 to 60 days, depending upon a patient's condition, a degree of obesity and also a dynamic of reducing a patient's weight during the treatment.

12. The method according claim 1, wherein changing the intensity of the second stimulating parameter includes adding a weight to the head.

13. The method according to claim 1, wherein changing the intensity of the second stimulating parameter includes adding a weight to the retainer.

14. The method according to claim 1, wherein the rod has a smooth surface and changing the intensity of the first stimulating parameter includes substituting the rod for a rod with a plurality of outwardly protruding pins.

15. The method of claim 14, further comprising rotating the rod 180 degrees.

16. The method according to claim 14, wherein the outwardly protruding pins are blunt.

17. The method according to claim 1, wherein the rod is straight and changing the intensity of the first stimulating parameter includes substituting the rod for a rod with a wave shape.

18. The method according to claim 1, further comprising stimulating the first and second auricular acupuncture points with physiotherapeutic action.

19. The method according to claim 18, wherein the stimulatory physiotherapeutic action is selected from the group including digital pressure, electric pulse, magnetic, acoustic, photo, micro- and short-wave stimulation.

* * * * *